United States Patent [19]

Mullen et al.

[11] 4,052,582

[45] Oct. 4, 1977

[54] ROTARY SELECTOR SWITCH

[75] Inventors: John H. Mullen; Glenn R. Taylor, both of Beaver, Pa.

[73] Assignee: Westinghouse Electric Corporation, Pittsburgh, Pa.

[21] Appl. No.: 665,139

[22] Filed: Mar. 8, 1976

[51] Int. Cl.[2] ..... H01H 3/42

[52] U.S. Cl. ..... 200/330; 200/16 A; 200/18; 200/153 L; 74/567

[58] Field of Search ..... 200/16 A, 17 R, 18, 200/30 R, 31 R, 38 B, 38 BA, 153 L, 153 LA, 153 LB, 307, 330, 336; 74/567, 568 R

[56] References Cited

U.S. PATENT DOCUMENTS

| | | | |
|---|---|---|---|
| 2,748,208 | 5/1956 | Koertge | 200/16 A |
| 2,878,368 | 3/1959 | Nolden et al. | 200/16 A |
| 2,967,215 | 1/1961 | Whiting | 200/153 L X |
| 3,169,406 | 2/1965 | Mullen | 200/16 A X |
| 3,914,571 | 10/1975 | Kellogg et al. | 200/330 |

*Primary Examiner*—James R. Scott
*Attorney, Agent, or Firm*—L. P. Johns

[57] ABSTRACT

A rotary selector switch characterized by a rotatable switch actuating unit and two switch structures, the actuating unit having a shaft with multiple sides on which a cam is detachably mounted for operation in a plurality of modes to operate the switch structures in different combinations of open and closed conditions, whereby a single cam mounted on the shaft in different positions is useful to operate the switch structures in a plurality of switch combinations.

7 Claims, 9 Drawing Figures

ROTARY SELECTOR SWITCH

BACKGROUND OF THE INVENTION

1. Field of the Invention:

This invention relates generally to electric control switches, and more particularly, it pertains to electric control switches of the type having reciprocating operating members.

2. Description of the Prior Art:

Heretofore, most rotary selector switch operators have been provided with different cams for different contact sequences. For example, some switch units comprise a simple contact arrangement which is convertible from a two to a three position unit. The primary disadvantages of such switches, of course, is the necessity of making and stocking a cam for each contact sequence. An example of a control switch operator is disclosed in U.S. Pat. No. 3,169,406, issued Feb. 16, 1965, to J. H. Mullen.

SUMMARY OF THE INVENTION

It has been found in accordance with this invention that problems associated with rotary selector switches of prior construction may be overcome by providing a rotary selector switch comprising a rotatable actuating unit and two switch structures; the rotatable actuating unit comprising a hexagonal end portion, a cam detachably mounted on the hexagonal end portion, each switch structure comprising a reciprocable plunger to effect opening and closing of electrical circuits through each switch, the plungers being movable by the cam, the cam being movably mounted on the shaft in one of three positions with respect to the plungers, the cam surface comprising a number of operative positions for the plungers including in sequence two up positions, one down position, one up position, and two down positions, and the rotatable actuating unit being rotated in a first direction from a first position to a second position to rotate said cam to effect movement of said plunger from a first combination of operating positions to a second combination of operating positions, and in a second direction from said first position to a third position to rotate said cam to effect movement of said plungers from said first to a third combination of operating positions.

The advantage of the device of this invention is that one cam may be provided with one rotary selector switch, which cam when mounted in one of three positions, may provide a plurality of different combinations of switch conditions when the rotatable actuating unit or handle is turned to one of three positions.

DESCRIPTION OF THE PREFERRED EMBODIMENTS

Figure 1:
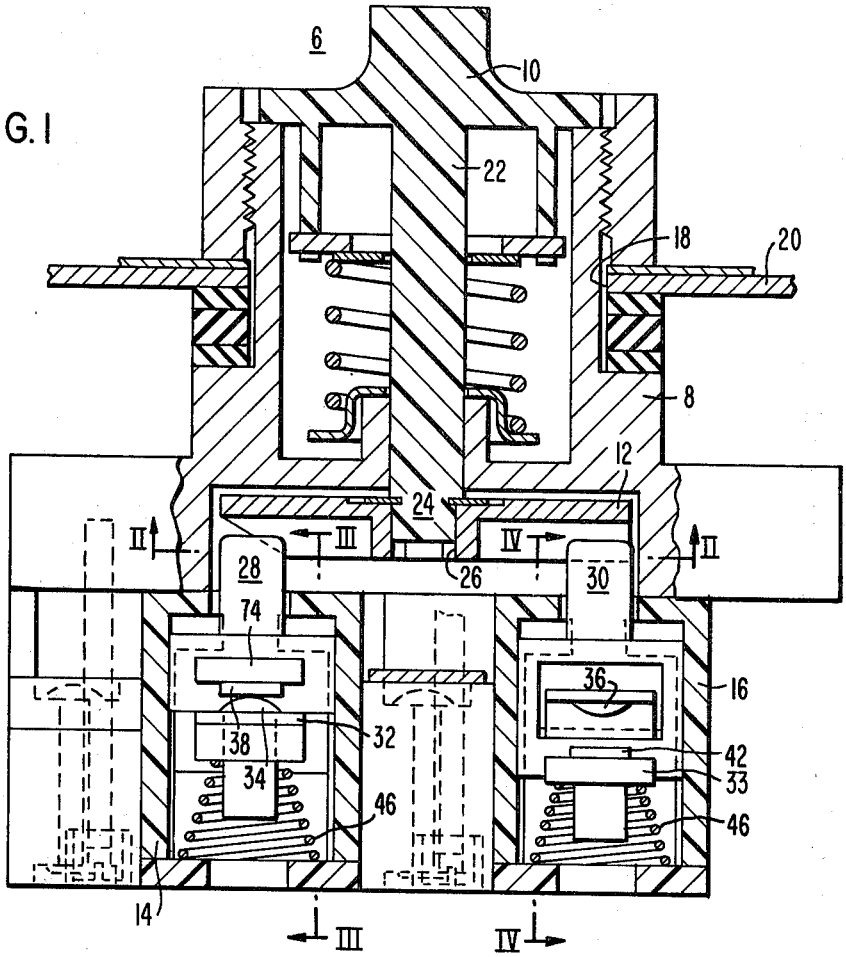
FIG. 1 is a vertical sectional view of a rotary selector switch embodying this invention.

In FIG. 1, the rotary selector switch or operating unit is generally indicated at 6, and it comprises a housing 8 of electrically insulating material, a handle or actuating unit 10, a cam 12, and a pair of switches 14, 16. The housing 8 extends through an aperture 18 in a panel 20 of an enclosure (not shown). Inasmuch as a detailed description of rotary selector switch 6 is set forth in U.S. Pat. No. 3,914,571, and of the switches 14, 16 in U.S. Pat. No. 3,018,338, the description herein is limited to those parts essential to the operation of the invention disclosed.

Figure 2:
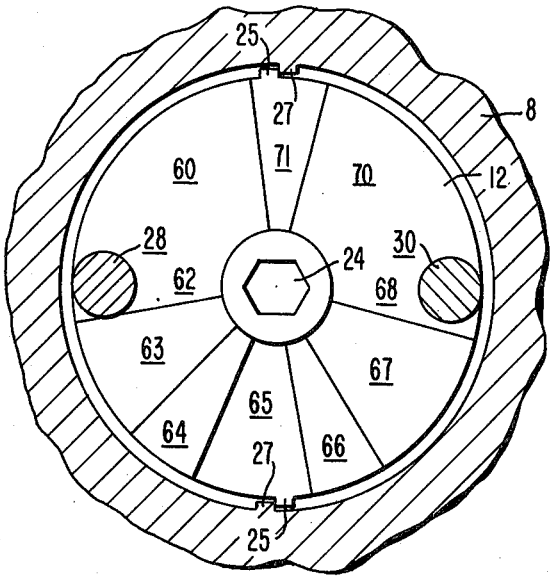
FIG. 2 is a horizontal sectional view taken on the line II—II of FIG. 1.

In accordance with this invention, the shaft end portion 24 has a polygonal cross-section, such as a hexagonal as shown. Any other polygonal cross-section having an even number of side surfaces, such as an octagon, decahedron, dodecahedron, may also be used. As shown in FIG. 2, the handle 10 (or the cam 12) may be rotated up to 180° due to stop means provided, such as a projection 25 on the periphery of the cam which abuts a corresponding projection 27 on the housing 8. Where a six-sided (hexagonal) cross-section for the shaft end portion 24 is provided, the handle 10 is rotated through 60° for each position of the cam. Where another polygonal cross-section, such as eight sides, is provided for the shaft end portion 24, the handle 10 is rotated through 45° for each cam position; that is, the number of degrees for each cam position equals the value of 360 degrees divided by the number of sides of the shaft end portion 24. For example, a hexagonal cross-section rotates through 60° (360° divided by 6) and an octagonal cross-section rotates through 45° (360° divided by 8). Manifestly, the cam 12 includes an aperture 26 having sides corresponding to the cross-section of the end portion 24. Thus, the cam 12 and the handle 10 are compatible so that the cam is movable through a plurality of modes with respect to the switches 14, 16, as will be set forth hereinbelow.

Figure 3:
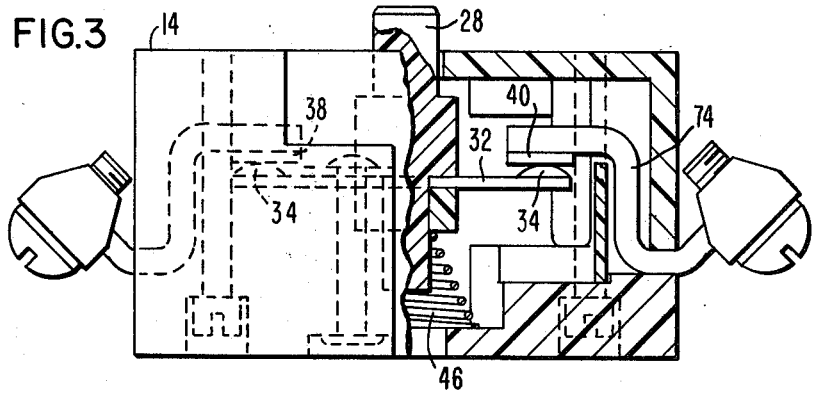
FIG. 3 is a vertical sectional view, partly in elevation, taken on the line III—III of FIG. 1, showing a normally closed switch.
Figure 4:
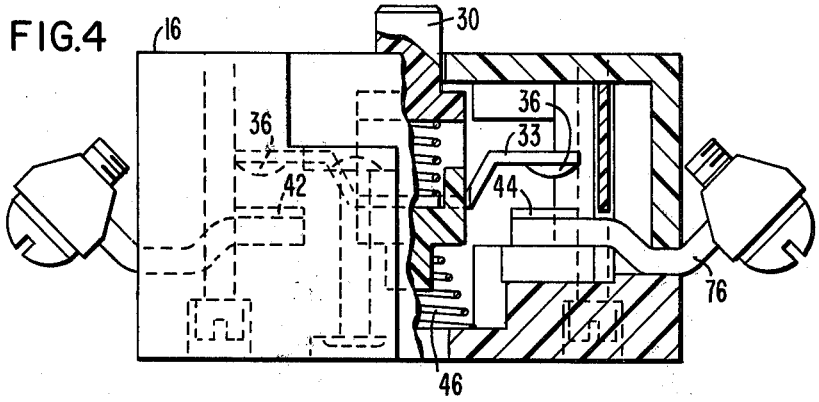
FIG. 4 is a vertical sectional view, partly in elevation, taken on the line IV—IV of FIG. 1, showing a normally open switch.
Figure 5:
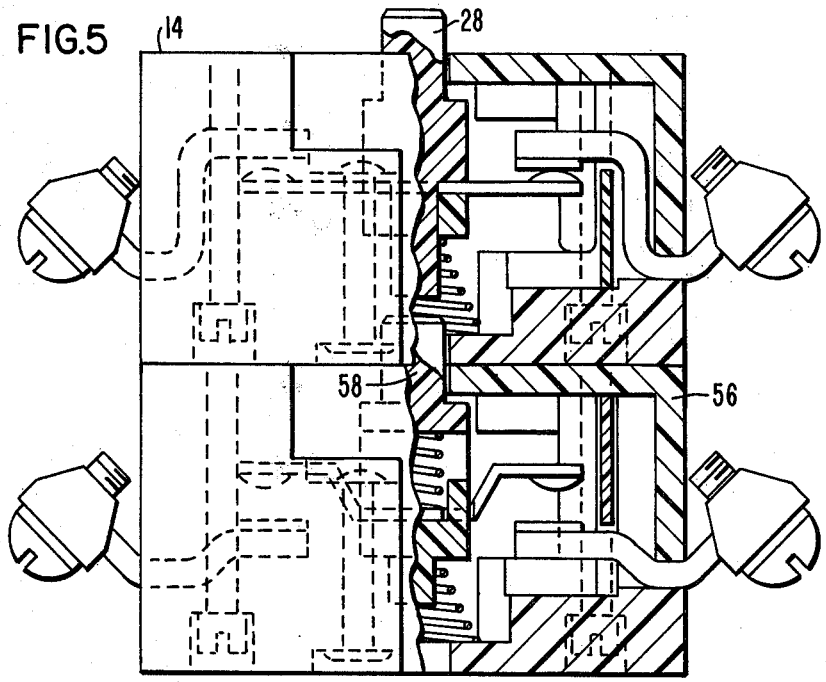
FIG. 5 is a vertical sectional view, partly in elevation, showing a pair of normally open and normally closed switches in tandem.

The switches 14, 16 comprise plungers or operating members 28, 30, respectively, contact carriers 32, 33, and movable contacts 34, 36. The switch 14 being normally closed includes upper stationary contacts 38, 40 (FIG. 3), and the switch 16 being a normally open switch includes lower stationary contacts 42, 44 (FIG. 4). Similar springs 46 in each switch 14, 16 hold the plungers 28, 30 in the upper position against the surfaces of the cam 12.

The pair of switches 14, 16 are required for the operation of this invention with one switch being on the right, and the other on the left side of the selector switch 6, and with one switch 14 being in the normally closed position and the other switch 16 being in the normally open position. However, additional switches may be added to either or both of the switches 14, 16 in tandem form as shown for the switch 56 attached to the switch 14, whereby the switch 56 comprises a plunger 58 in end-to-end abutment with the plunger 28 of the switch 14. The switch 56 may be either normally closed or normally open as shown.

In accordance with this invention, the cam 12 provides all of the functions of prior switch constructions which required a plurality of cams to perform all of the various functions; namely, two switches in the various combinations of open and closed circuits, which switches are preferably normally open and normally closed pairs of switches. In the schematic view of FIG. 6D, the cam 12 is shown in a linear development. If the handle 10 is rotated 60° per position, the cam 12 has six positions including positions 60, 62, 64, 66, 68, 70. Each position begins where the adjacent position terminates so that a circular cam presents a continuous cam surface. Thus, the cam includes, sequentially commencing at position 60, two up positions 60, 62; one down position 64; one up position 66; and two down positions 68, 70, with slope surfaces 63, 65, 67, and 71 disposed as shown in FIG. 6D. The cam 12 is placed on the shaft end portion 24 in the required position, such as for example, the position in which the plungers 28, 30 engage the positions 62, 68, respectively, on diametrically opposite sides of the axis of the shaft 22. Thus, the plunger 28 is in the normally closed position (FIG. 3) and the plunger 30 of the switch 16 (FIG. 4) is in the closed position. When the handle 10 is rotated clockwise or counterclockwise, the cam 12 rotates with respect to the plungers 24, 30 in one direction with the plunger 28 at the position 60 and the plunger 30 at the position 66, whereby both plungers are up and the switch 14 is closed and the switch 16 is open. When the cam 12 is moved in the opposite direction, the plunger 28 is at the down position 64 and the plunger 30 is at the down position 70, whereby the switch 14 is in the open condition and the switch 16 is closed.

Figure 6A:
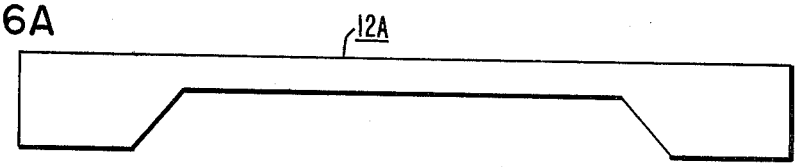
PRIOR ART FIG.6A
FIG. 6 is a schematic view showing the profile of the cam surface ((FIG. 6D) of this invention compared with the three cams (FIGS. 6A, 6B, 6C) of the prior art construction.
Figure 6B:
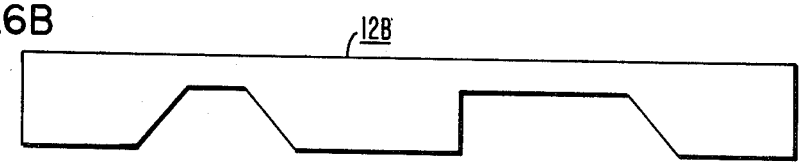
Figure 6C:
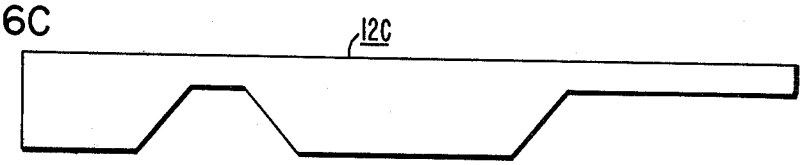
Figure 6D:
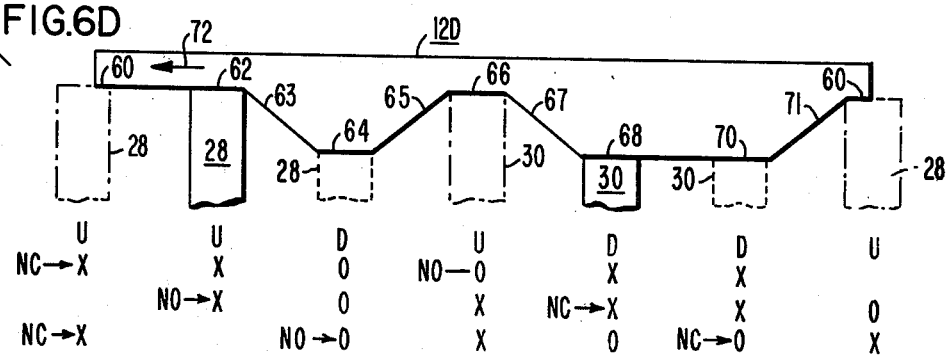

By providing the normally closed switch 14 and the normally open switch 16, the up and down positions (U, D) as indicated under the several cam positions (FIG. 6D) duplicate the functions of the cam 12A, 12B, 12C of a group of cams in FIGS. 6A, 6B, and 6C, which had been used heretofore to obtain all of the functions now obtained by the cam 12D (FIG. 6D) in accordance with this invention. As shown under the surface of cam 12D, the sequence of cam positions are U, U, D, U, D, D, which positions correspond to open or closed circuits depending upon whether the switch is normally open or normally closed. Under the surface positions of the cam 12D (FIG. 6D) for a normally open and normally closed switch, the letters "*x*" and "*o*" indicate closed and open switch conditions. Accordingly, the normally open (NO) and normally closed (NC) conditions are indicated under the cam A. By using cam 12D with a normally closed switch 14 on the left as viewed in FIG. 6D, and a normally open switch 16 as viewed on the right, the functions of prior art cams 12A, 12B, 12C are obtained.

In a similar manner, the functions of prior art cam 12B may be obtained when the cam 12D is removed from the shaft end portion 24 and rotated one section in the direction indicated by the arrow 72 so that plungers 28, 30 are now located at the cam positions 64, 70. Thereafter, rotation of the handle 10 in one direction moves the cam 12D until the plungers 30 move to the cam positions 62, 68, respectively, while rotation of the handle 10 in the opposite direction moves the same plungers to the cam positions 66, 60, respectively. In order to obtain the same functions as the prior art cam 12B, the switches 14, 16 are converted to normally open and normally closed switches, which conversions are relatively simple in that the contact strips 74, 76 as well as the contact carriers 32, 34 are interchangeable.

To obtain the functions of the prior art cam 12C, the cam 12D may be rotated one more position in the direction of the arrow 72 until the plungers 28, 30 are in the positions 66, 60 of the cam and the switches 14, 16 are both normally closed switches. Thus, when the handle 10 is rotated, the plungers 28, 30 move in one direction to the cam positions 64, 70, respectively, and in the other direction to the cam positions 68, 62.

In accordance with this invention, many useful different combinations of switch conditions may be obtained by a combination of three factors, including: (1) a normally open or normally closed contact block or switch on either side of the selector switch; (2) a rotatable selector switch shaft having a polygonal surface equal to the value of 360° divided by an even whole number; and (3) a particular cam surface having the sequence disclosed herein. More particularly, the various modes of the switch functions are obtained by either changing the position on the shaft and/or converting one or both of the contact blocks from normally open to normally closed conditions. The handle of the actuating unit 10 is rotated in a first direction from a first position to a second position to rotate the cam to effect movement of the plungers from a first combination of operating positions to a second combination of operating positions. The handle is also rotatable in a second direction from the first position to a third position to rotate the cam to effect movement of the plungers from the first to a third combination of operating positions. Thus, the handle is rotatable between three cam positions for each mode or setting of the cam on the shaft of the actuating unit. Finally, although it is preferred that the cam shaft end portion and cam be provided with six sides, three for each switch, an eight-sided shaft and cam aperture may also be used with a three position switch, with the extra side on each half being unused. An eight-sided shaft is used preferably with two four-position switch; and a ten-sided shaft is preferably used with two five-position switches.

In conclusion, the rotary selector switch of this invention solves the problem inherent in the prior art which required three (or more) cams for obtaining a plurality of functions of a three (or more) position switch, by providing a single cam having a particular sequence of cam surfaces and interchanging or converting normally open and normally closed switches where necessary to suit the particular mode of cam action as required.

What is claimed is:

1. A rotary selector switch comprising a rotatable actuating unit and two switch structures, a housing, the rotatable unit in the housing and comprising a rotatable selector mechanism, said mechanism comprising a detachably mounted cam, means limiting rotation of the cam to about 180°, each switch structure having a reciprocable contact operating member to effect opening and closing of a circuit through the switch structure, the mechanism and the cam having mutually inter-fitting means to enable removal and repositioning of the cam in an alternate mode of operation with respect to the contact operating members, the cam having camoperating surface means for actuating the contact operating members and comprising a number of operating positions for the operating members including in sequence two adjacent up positions, two adjacent down positions, a single down position, and a single up position.

2. The rotary selector switch of claim 1 in which the actuating unit is rotatable in a first direction from a first position to a second position to rotate said cam to effect movement of said switch operating members from a first combination of operating positions to a second combination of operating positions, and in a second direction from said first position to a third position to rotate said cam to effect movement of said switch operating members from said first to a third combination of operating positions.

3. The rotary selector switch of claim 1 in which one of the cam and unit comprise projection means and the other of the cam and unit comprise projection-receiving means.

4. The rotary selector switch of claim 3 in which the projection means comprises a shaft having a number of external surfaces equal to the number of positions on the cam.

5. The rotary selector switch of claim 4 in which the cam includes the projection-receiving means.

6. The rotary selector switch of claim 5 in which the reciprocable operating members are diametrically oppositely disposed.

7. The rotary selector switch of claim 6 in which there are six external surfaces on the shaft.

* * * * *